US008149075B2

(12) United States Patent
Navarre et al.

(10) Patent No.: US 8,149,075 B2
(45) Date of Patent: Apr. 3, 2012

(54) PLASTIC CRADLE

(75) Inventors: Larry Navarre, Norcross, GA (US); Hai Chen, Duluth, GA (US); Hector Malacara, Norcross, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/030,480

(22) Filed: Feb. 18, 2011

(65) Prior Publication Data

US 2011/0205005 A1 Aug. 25, 2011

Related U.S. Application Data

(60) Provisional application No. 61/305,993, filed on Feb. 19, 2010.

(51) Int. Cl.
*H01H 75/00* (2006.01)

(52) U.S. Cl. ..... 335/6; 335/21

(58) Field of Classification Search ..... 335/6, 8–10, 335/21

See application file for complete search history.

(56) References Cited

U.S. PATENT DOCUMENTS 6,809,282 B2 * 10/2004 Fasano ..... 218/40

* cited by examiner

*Primary Examiner* — Ramon Barrera

(57) ABSTRACT

The present invention relates generally to a plastic cradle. More particularly, the invention encompasses a plastic cradle utilized inside a molded circuit breaker (MCB). The present invention is also directed to a novel nonconductive nonmagnetic cradle that engages a contact arm between a first terminal conductor and a second terminal conductor inside a molded circuit breaker (MCB) in an ON state, and disengages same in an OFF or Neutral state.

26 Claims, 3 Drawing Sheets

PLASTIC CRADLE

CROSS-REFERENCE TO RELATED APPLICATION

The instant patent application claims priority to and the benefit of pending U.S. Provisional Patent Application Ser. No. 61/305,993, filed on Feb. 19, 2010, titled "Plastic Cradle," the entire disclosure of which provisional application is incorporated herein by reference.

FIELD OF THE INVENTION

The present invention relates generally to a plastic cradle. More particularly, the invention encompasses a plastic cradle utilized inside a molded circuit breaker (MCB). The present invention is also directed to a novel nonconductive nonmagnetic cradle that engages a contact arm between a first terminal conductor and a second terminal conductor inside a molded circuit breaker (MCB) in an ON state, and disengages same in an OFF or Neutral state.

BACKGROUND INFORMATION

Circuit breakers typically have an operating mechanism, and a tripping mechanism, such as, a thermal trip assembly and/or a magnetic trip assembly, which are automatically releasable to effect the tripping operation, and then are manually resettable following the tripping operation.

Such circuit breakers, have commonly been referred to as "miniature" circuit breakers, and have been in use for many years. Their design has been improved upon so as to provide an effective, reliable circuit breaker, which can be easily and economically manufactured on a large scale. In addition, circuit breakers of this type may be utilized in conjunction with are fault and/or ground fault trip mechanisms as well.

Circuit breakers of this type include at least one set of separable contacts disposed within a non-conductive housing. Typically, there is a fixed contact attached to the housing and a movable contact coupled to the operating mechanism. The operating mechanism includes a movable operating handle that extends outside of the housing. The operating mechanism further includes an operating arm, upon which the movable contact is disposed, the trip mechanism, and a cradle. The cradle is coupled to a spring and is pivotally disposed between the trip mechanism and the operating arm. One portion of the cradle pivots with respect to the housing while another portion of the cradle has a latch ledge, which is latched by the trip mechanism.

The operating member or handle has essentially two or three stable positions: (1) ON and OFF; or (2) ON, OFF and TRIPPED. In the latter case, the three positions tell the operator what condition the circuit breaker is operating in when viewed. In normal operation, the handle is maintained in the ON position. Then, once the trip mechanism is automatically released, in order to protect electrical circuitry from damage due to an overcurrent condition, such as, an overload or relatively high level short circuit, the handle automatically moves to the TRIPPED position. The circuit breaker must then be reset, as is well known in the art, by moving the handle beyond the OFF position to a RESET position from which the handle returns to the OFF position when released. The circuit breaker may then be manually operated from the OFF to the ON position, in order to allow the circuit breaker to resume normal operation. In addition, the handle is manually maneuverable from the ON to the OFF position if it is desired to open the protected circuit. A typical circuit breaker is calibrated, for example, to maintain a current flow of 100% of its rated current and to trip within predetermined times at 135% or 200% of such rated current.

The following patents are indicative of the state of the art for miniature circuit breakers: U.S. Pat. No. 6,005,207 (Bernard DiMarco, et al.), U.S. Pat. No. 6,172,586 (James F. Ferree, et al.), U.S. Pat. No. 6,392,512 (James Edward Ferree, et al.), U.S. Pat. No. 6,850,134 (Edward E. Lias, et al.), U.S. Pat. No. 6,894,594 (Joseph P. Fello, et al,), and U.S. Pat. No. 7,800,007 (Narayansamy Soundararajan, et al.).

However, there is room for improvement in circuit breaker operating mechanisms to prevent arcing, magnetic flux physically displacing component, heat degenerating components.

This invention improves on the deficiencies of the prior art, and provides an inventive molded circuit breaker (MCB).

PURPOSES AND SUMMARY OF THE INVENTION

The invention is a novel molded circuit breaker (MCB).

Therefore, one purpose of this invention is to provide a molded circuit breaker (MCB).

Another purpose of this invention is to provide a non-electrically conductive cradle in a molded circuit breaker (MCB).

Yet another purpose of this invention is to provide molded non-electrically conductive cradle for use in a molded circuit breaker (MCB).

Therefore, in one aspect this invention comprises a molded circuit breaker for an electrical circuit, comprising:

(a) a first terminal conductor having at least one connector means;

(b) a second terminal conductor having at least one stationary contact;

(c) a magnet, a bimetallic strip, and an armature in electrical contact with at least a portion of said first terminal conductor, said armature having an armature pivot arm, and an armature opening;

(d) a nonconductive nonmagnetic cradle having an operating spring opening, a first cradle extension and a second cradle extension, said first cradle extension has a cradle kick, a cradle pivot and a circuit breaker reset arm, said second cradle extension has a latch kick; and (e) a contact arm having a spring hook, and a movable contact, such that a first end of an operating spring is in engageable contact with said operating spring opening and a second end of said operating spring is in engageable contact with said spring hook, and wherein in an ON position said movable contact is in electrical contact with said stationary contact, and in an OFF position said movable contact is disengaged from said stationary contact.

In another aspect this invention comprises a molded circuit breaker for an electrical circuit, comprising:

(a) a first terminal conductor having at least one connector means;

(b) a second terminal conductor having at least one stationary contact;

(c) a magnet, a bimetallic strip, and an armature in electrical contact with at least a portion of said first terminal conductor, said armature having an armature pivot arm, and an armature opening;

(d) a nonconductive nonmagnetic cradle having a first cradle extension and a second cradle extension, said first cradle extension has a first body portion, wherein said first body portion has an operating spring opening at an upper end, a pivot extension at a lower end, and between said upper end and said lower end of said first body portion having a circuit breaker reset arm on a first side and a cradle kick on a second side, said pivot extension has a cradle pivot, said second cradle extension has a second body portion, wherein said second body portion has a latch extension having a latch kick; and (e) a contact arm having a spring hook, and a movable contact, such that a first end of an operating spring is in engageable contact with said operating spring opening and a second end of said operating spring is in engageable contact with said spring hook, and wherein in an ON position said movable contact is in electrical contact with said stationary contact, and in an OFF position said movable contact is disengaged from said stationary contact.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1:
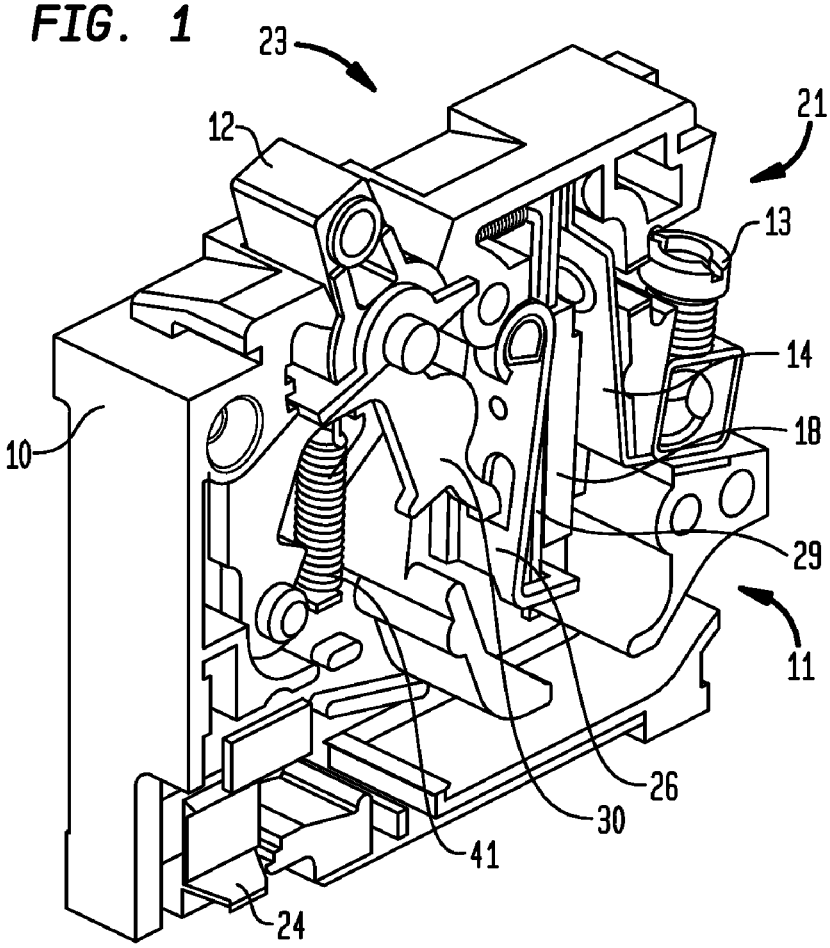
FIG. 1 illustrates a front perspective view of an inventive circuit breaker in accordance with one aspect of the present invention.

The inventive cradle is one part of the circuit breaker which is used to operate the molded circuit breaker (MCB). It should be appreciated that in the prior art the cradle is a ferrous material, such as, steel or stainless steel materials, which are also electrically conductive materials. The ferrous material is always attracting the arc during fault current, creating a secondary current path. The ferrous material of the cradle of the prior art generates a magnetic field when current flows through the cradle thus causing magnetic attractive forces on the adjacent metal parts thus causing displacement of the adjacent part. However, with a nonconductive and nonmagnetic cradle of this invention, the tracking or attracting of the arc during fault current is prevented. Since, the non-electrically conductive and non-magnetic cradle of this invention cannot conduct an electrical current, no magnetic field is generated, eliminating the magnetic forces on the adjacent components to cause displacement. The nonconductive and nonmagnetic cradle of this invention is composed of a nonconductive, nonferrous material such as a plastic.

As stated earlier the low voltage circuit breaker is designed to protect an electric circuit and its components due to overload and short circuit. Its basic function is to detect a fault condition, by interrupting continuity, to immediately discontinue electrical flow.

Three basic operating conditions must be presented on each circuit breaker, which are close electric circuit, open the electric circuit, and reset if the circuit breaker is tripped by overload and/or short circuit. The cradle is one of the components to accomplish these operations.

As stated earlier, there are several major problems presented by the cradles of the prior art. For example, the steel cradles attract the arc when the contacts open, which results in the arc sugaring and eroding of the operating parts unexpectedly.

Additionally, the electrical conductivity creates a second undesirable current path which is parallel to the main current path. During the current fault the second current path could pass enough current sharing with the main current path, which will heat each part of the second path and anneal some of them. Consequently some of the operating parts are disabled.

Furthermore, an electric sparking and arcing could happen due the difference of the electric potentials between the main and the second current path. In this case the parts could be damaged or even welded to each other and may not be able to function.

Moreover, due to the use of ferrous material the magnetic flux is created during the arc fault which also causes the magnetic field, which in turn also causes the physical displacement of some of the metal parts, such as, for example, the braid, and particularly those parts that are formed of a ferrous material. It has now been discovered that the physical displacement of the metal parts also causes failure in the whole mechanical system. Additionally, the conventional metal cradle is difficult to manufacture in terms of dimensional control under the manufacturing process.

The molded circuit breaker for an electrical circuit of this invention has a line terminal having a stationary contact, an operating mechanism for separating contacts by handle, plastic cradle, a contact arm having a movable contact, and an operating spring, a trip unit for actuating or operating mechanism to latch or de-latch when a fault and or over load current are detected in electrical circuit, which include armature, armature spring, bimetal, load terminal, and a wire connector.

The plastic cradle is a nonconductive, nonmagnetic material, which eliminates the secondary electric path, even though the plastic cradle is physically close to or adjacent the electric circuit or electrically conductive materials, such as, the armature, operating spring, contact arm, movable contact, stationary contact, load terminal, line terminal, etc.

The nonconductive, nonmagnetic cradle of the molded circuit breaker of this invention eliminates the magnetic field generated by the current when overload and/or fault current as in the cradle of the prior art, thus eliminating any physical forces on adjacent parts or parts in close proximity and not causing damage to the adjacent parts.

With the plastic cradle in the place, the elimination of the secondary current path prevents arcing and/or sparking between the cradle of this invention and the braid since no electric potential can exist.

The metallic cradle of the prior art is a stamped part to meet the requirements of the strength and the dimensionality. When the arc occurs during the arc fault, it will erode and heat some parts near the metallic cradle, which further disables the operating system. This also creates the secondary current path white the contacts are closed.

The arc erosion damages the contact arm, operating spring, and the metallic cradle itself thus causing the circuit breaker to potentially malfunction. The failure of the metallic cradle of the prior art within the circuit breaker causes failure of required standard tests.

The secondary current path permits current flow when the contacts are not closed. This in turn heats the parts of the path, such as the operating spring. The overheating of the operating spring anneals and disables the operating spring and ultimately causes failure.

The tolerances of the dimensions during the process in the stamping and the plating of the metallic part are difficult to control in the manufacture of the ferrous metal cradle of the prior art. In the manufacture of the molded non-metallic, nonconductive, nonmagnetic cradle of this invention, the tolerance is easy to control. The nonmetallic nonconductive, nonmagnetic cradle of this invention will not be plated as the ferrous metal cradle of the prior art, thus the nonconductive, nonmagnetic cradle of this invention will be a more environment friendly product and will also result in the cost reduction of the part.

The low voltage molded circuit breaker is packed by several major units which includes the operation mechanism, thermal and magnetic trip unit, terminals and lugs, arc quenching assembly, and a molded plastic case. In the operation mechanism unit it includes four parts which are a handle, an operating spring, a cradle, and a movable contact arm. In this invention a molded plastic cradle is introduced to replace a metallic cradle.

In the switch operation or close and open the electric circuit, the plastic cradle does not rotate. It supports the operating spring while the handle swings between "ON' and "OFF" positions. When an over load and a fault current are detected in the electric circuit the circuit breaker is de-latched immediately. The plastic cradle is forced to rotate direction rapidly. In this situation the arc is drowned by the movable contact, directed towards the arc chutes, and is not attracted by the plastic cradle. This invention also eliminates the second electric path, prevents annealing of the parts, does not generate sparks, and limits the braids movement to disable the operating system.

Referring now to FIGS. 1-5, where FIG. 1 illustrates a front perspective view of an inventive circuit breaker 23, in accordance with one aspect of the present invention, where the circuit breaker 23, comprises a non-electrically conductive or plastic or non-metallic housing 10, having a cavity 11, to accommodate circuit breaker operating components or assembly 21. The plastic housing 10, has a handle member or switch 12, that typically protrudes out of the plastic housing 10. A non-metallic non-electrically conductive non-magnetic cradle 30, a first terminal conductor or toad terminal 14, and a second terminal conductor or tine terminal 24, having a stationary contact 44, are typically contained inside the cavity 11, and are a part of the circuit breaker operating components or assembly 21. Some of the other components of the circuit breaker operating components or assembly 21, include, but are not limited to, a magnet 18, a bimetal strip 29, an armature 26, to name a few. One end of a cradle operating spring 41, is engaged to the plastic cradle 30, via an operating spring hole or opening 31, shown in FIG. 2. The load terminal 14, is in electrical contact with a wire connector 13. An armature 26, is engageably in contact with the plastic cradle 30, and a bimetallic strip 29.

Figure 2:
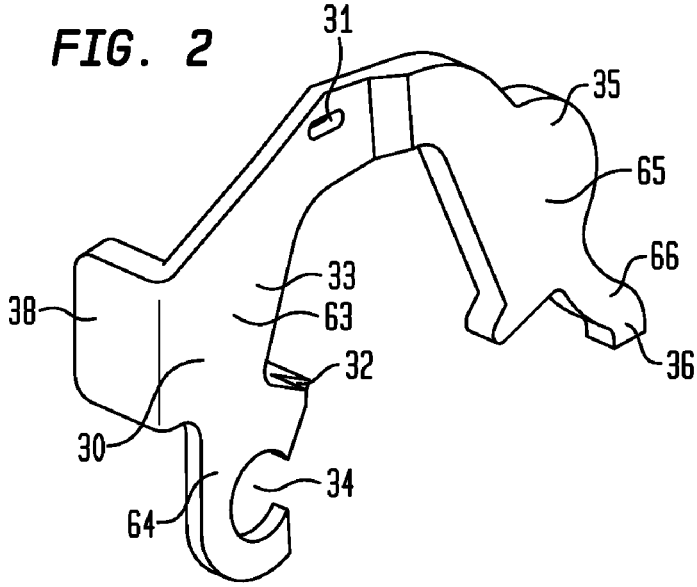
FIG. 2 is a detailed perspective view showing the inventive molded plastic cradle in according to one aspect of this invention.

FIG. 2 is a detailed perspective view showing the inventive molded ptas cradle 30, in according to one aspect of this invention. The plastic cradle 30, has a first cradle extension 33, a second cradle extension 35, and an operating spring hole or opening 31. The first cradle extension 33 and the second cradle extension 35 are substantially planar. The first cradle extension 33, has a cradle pivot 34, a cradle kick or ledge 32, and a circuit breaker reset arm 38. The circuit breaker reset arm 38 is substantially perpendicular to at least a portion of said first cradle extension 33. The second cradle extension 35, has a latch kick or ledge 36. The first cradle extension 33, has a first body portion 63, having an operating spring opening or hole 31, at an upper end, and a pivot extension 64, at a lower end, and wherein between the upper end and the lower end of the first body portion 63, is the circuit breaker reset arm 38, and the cradle kick or ledge 32. The pivot extension 64, has the cradle pivot 34. The second cradle extension 35, has a second body portion 65, having a latch extension 66. The latch extension 66, has the latch kick or ledge 36. For some embodiments the second body portion 65, will have an average thickness that is greater than the average thickness of the first body portion 63. The cradle pivot 34, is preferably shaped in a circular shape or in a C-shape with an opening so as to pivot around a cradle pivot knob 54, shown in FIGS. 4 and 5. The cradle kick or ledge 32, preferably has a fiat or planar surface so as to be able to move about a kick feature of a contact arm 40, shown in FIGS. 4 and 5. The cradle ledge 32, extends substantially inwardly towards the second cradle extension 35, while the cradle pivot 34, has a substantial circular shape within an opening facing outwardly towards the second cradle extension 35. For most applications the latch ledge 36, protrudes outwardly and away from the operating spring opening 31. For some applications it is preferred that the average thickness of the second cradle extension 35, is greater than the average thickness of the first cradle extension 33.

Figure 3:
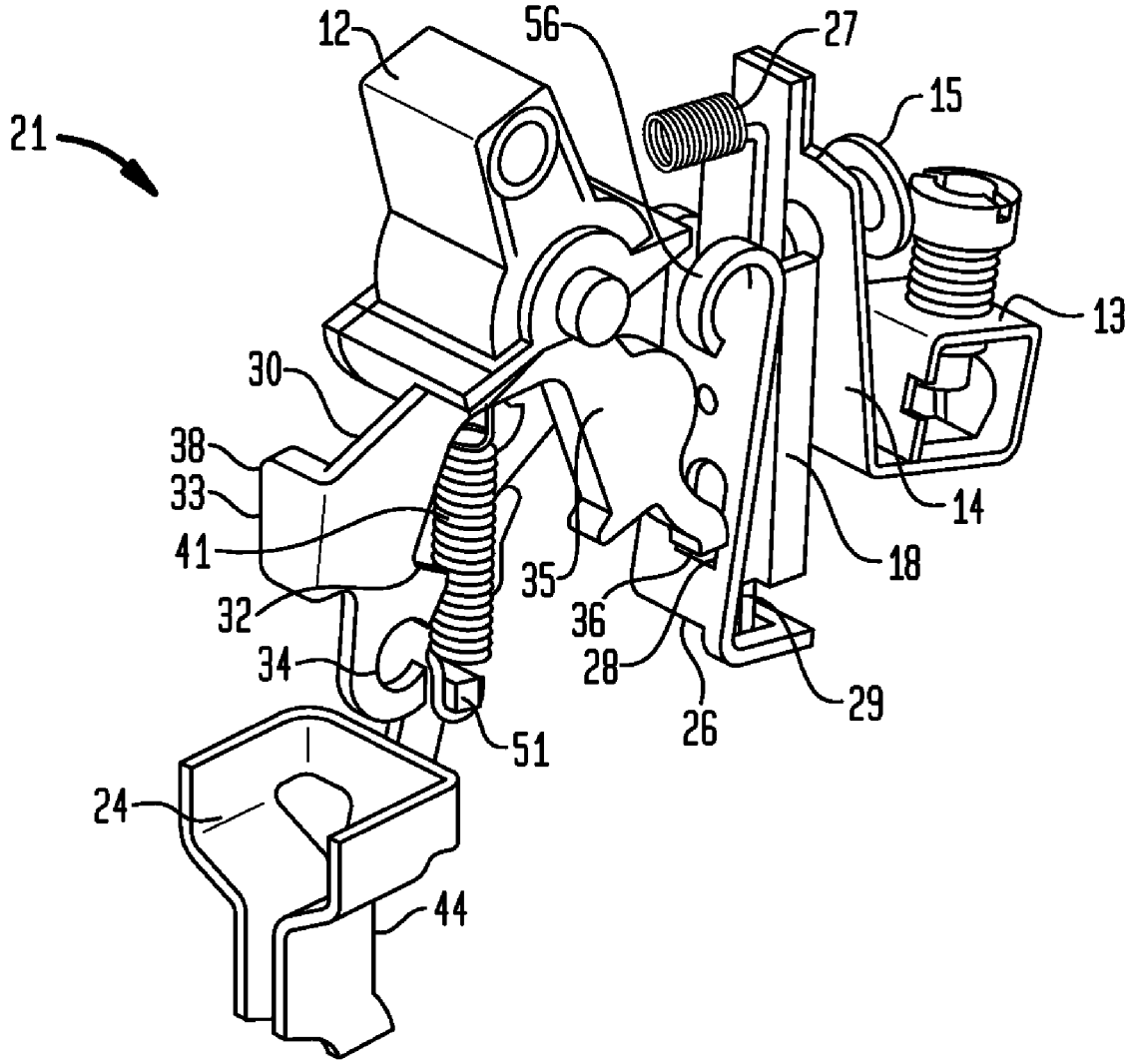
FIG. 3 illustrates internal assembly parts of the inventive circuit breaker in accordance with the present invention, but without the base and the cover.

FIG. 3 illustrates internal assembly parts of the inventive circuit breaker assembly 21, in accordance with the present invention, but without the plastic base 10 of FIG. 1, and a cover. The armature 26, has an armature spring 27, an armature pivot arm 56, and an opening 28, to which in engageable contact is the latch kick or ledge 36, of the plastic cradle 30. The circuit breaker assembly 21, has a magnet 18, in engageable contact with the load terminal 14, and the bimetallic strip 29. One end of the cradle operating spring 41, is securely engaged to the operating spring hole or opening 31, of the plastic cradle 30, while the opposite end is securely engaged with spring hook or tab 51, of a contact arm 40, shown in FIGS. 4 and 5. A calibration screw 15, is provided with the circuit breakers 23, so as to adjust and make desired contact at the location of the load terminal 14. Secured to the line terminal or second terminal conductor 24, is at least one stationary contact 44.

Figure 4:
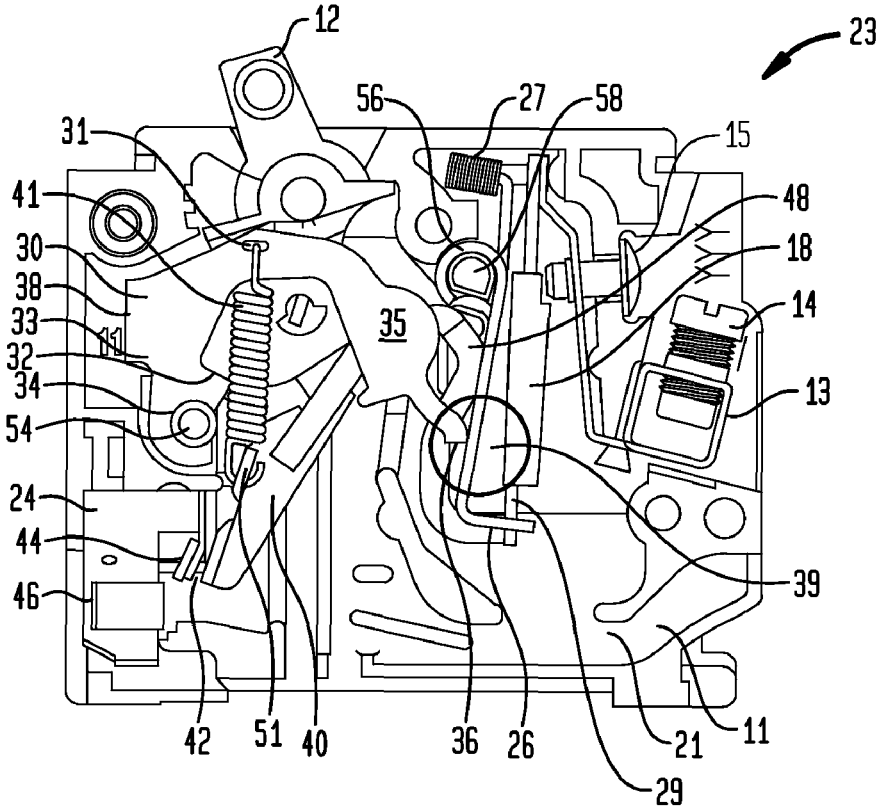
FIG. 4 is a detailed front view showing the latch or ON state of the inventive circuit breaker.

FIG. 4 is a detailed front view showing the latch or ON state of the inventive circuit breaker 23. A braid 48, is in electrical contact with the armature 26, and the contact arm 40, during the latch or ON state. The contact arm 40, has at least one moveable contact 42, which is in physical contact with at least one stationary contact 44, at the location of the line terminal 24, during the ON state. A spring clip 46, may be provided to secure the tine terminal 24, to a line feature (not shown). A detailed view of latch location 39, is shown in FIG. 4, where the latch kick or ledge 36, of the plastic cradle 30, is in secure and engageable contact with the opening 28, of the armature 26. The cradle pivot 34, of the plastic cradle 30, is engaged to a pivot knob 54, such that the plastic cradle 30, can pivot around the pivot knob 54. The armature pivot arm 56, is engaged with an armature pivot knob 58, such that the armature 26, can pivot around the armature pivot knob 58. In the switch operation or close and open the electric circuit, the plastic cradle 30, does not rotate. The plastic cradle 30, supports the cradle operating spring 41, while the handle or switch 12, is swung between "ON' and "OFF" positions. A first end of the cradle operating spring 41, is engaged to the plastic cradle 30, via the operating spring hole or opening 31, while the opposite or second end of the cradle operating spring 41, is securely engaged to and held by the spring hook or tab 51, of the contact arm 40.

Figure 5:
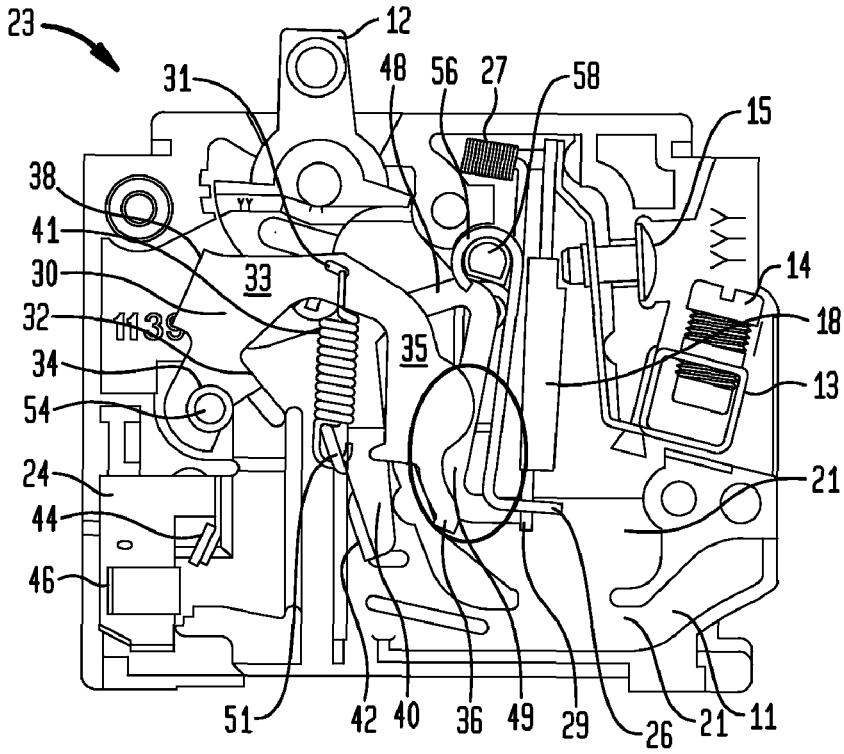
FIG. 5 is a detailed front view of the inventive circuit breaker in accordance with the present invention in a delatched or Neutral or Tripped or OFF state.

FIG. 5 is a detailed front view of the inventive circuit breaker 23, in accordance with the present invention in a de-latched or Neutral or Tripped or OFF state. When an overload and/or a fault current is detected in the electric circuit the circuit breaker 23, is de-latched immediately. The plastic cradle 30, is forced to rotate in the clockwise direction rapidly and the circuit breaker 23 goes into a de-latched or Neutral or Tripped or OFF state. View of the de-latched state 49, shows that the latch kick or ledge 36, of the plastic cradle 30, has disengaged from the opening 28, of the armature 26, and the plastic cradle 30, has rotated or pivoted about the cradle pivot knob 54, such that the movable contact 42, of the contact arm 40, has also disengaged from the stationary contact 44, of the line terminal 24. Once tripped or de-latched, the circuit breaker 23, can be reset manually by moving the handle or switch 12, from the OFF position to the ON position, which allows the circuit breaker reset arm 38, to engage the contact arm 40, and move the complete circuit breaker operating assembly 21, into an ON state.

The molded circuit breaker 23, comprising of a trip unit connected such that the nonconductive nonmagnetic cradle 30, automatically rotates to disengage the movable contact 42, from the stationary contact 44, to actuate the OFF position in response to a predetermined electrical overload and fault current. It should be understood that the non-electrically conductive cradle 30, is not excited by an electrical current to establish a magnetic field when the trip unit automatically actuates the OFF position in response to a predetermined electrical overload and fault current. Furthermore, the non-electrically conductive cradle 30, prevents a secondary conducting path, while a primary conductive path is created via the second terminal conductor 24, magnet 18, bimetallic strip 29, armature 26, contact arm 40, movable contact 42, stationary contact 44, and the first terminal conductor 14, in an ON position. It should be appreciated that the handle 12, can be used to move the non-electrically conductive cradle 30, from an OFF position to an ON position, and vice versa. For most applications at least a portion of the braid 48, is adjacent the nonconductive, nonmagnetic cradle 30, and wherein there is no arcing and sparking between the braid 48, and the non-electrically conductive cradle 30, when a trip unit automatically actuates the OFF position in response to a predetermined electrical overload and fault current.

It is preferred that the non-electrically conductive cradle 30, is made from a material selected from a group comprising plastic materials, polymer material, polyester material, non-conductive material, non-ferrous material, composite material, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A molded circuit breaker for an electrical circuit, comprising:

(a) a first terminal conductor having at least one connector means;

(b) a second terminal conductor having at least one stationary contact;

(c) a magnet, a bimetallic strip, and an armature in electrical contact with at least a portion of said first terminal conductor, said armature having an armature pivot arm, and an armature opening;

(d) a nonconductive nonmagnetic cradle having an operating spring opening, a first cradle extension and a second cradle extension, said first cradle extension has a cradle kick, a cradle pivot and a circuit breaker reset arm, said second cradle extension has a latch kick; and (e) a contact arm having a spring hook, and a movable contact, such that a first end of an operating spring is in engageable contact with said operating spring opening and a second end of said operating spring is in engageable contact with said spring hook, and wherein in an ON position said movable contact is in electrical contact with said stationary contact, and in an OFF position said movable contact is disengaged from said stationary contact.

2. The molded circuit breaker for an electrical circuit of claim 1, further comprising a trip unit connected such that said nonconductive nonmagnetic cradle automatically rotates to disengage said movable contact from said stationary contact to actuate said OFF position in response to a predetermined electrical overload and fault current.

3. The molded circuit breaker for an electrical circuit of claim 2, wherein said non-electrically conductive cradle is not excited by an electrical current to establish a magnetic field when said trip unit automatically actuates said OFF position in response to a predetermined electrical overload and fault current.

4. The molded circuit breaker for an electrical circuit of claim 1, wherein said non-electrically conductive cradle prevents a secondary conducting path, while a primary conductive path is created via said second terminal conductor, magnet, bimetallic strip, armature, contact arm, movable contact, stationary contact, and said first terminal conductor in an ON position.

5. The molded circuit breaker for an electrical circuit of claim 1, wherein material for said non-electrically conductive cradle is selected from a group consisting of a plastic material, a polymer material, a polyester material, a non-conductive material, a non-ferrous material, and a composite material.

6. The molded circuit breaker for an electrical circuit of claim 1, wherein a handle moves said non-electrically conductive cradle from an OFF position to an ON position.

7. The molded circuit breaker for an electrical circuit of claim 1, wherein at least a portion of a braid is adjacent said nonconductive, nonmagnetic cradle.

8. The molded circuit breaker for an electrical circuit of claim 1, wherein at least a portion of a braid is adjacent said non-electrically conductive cradle, and wherein there is no arcing and sparking between said braid and said non-electrically conductive cradle when a trip unit automatically actuates said OFF position in response to a predetermined electrical overload and fault current.

9. The molded circuit breaker for an electrical circuit of claim 1, wherein said first cradle extension and said second cradle extension are substantially planar, and wherein a circuit breaker reset arm extends substantially perpendicular to at least a portion of said first cradle extension.

10. The molded circuit breaker for an electrical circuit of claim 1, wherein said first cradle extension has a cradle ledge, and wherein said cradle ledge extends substantially inwardly towards said second cradle extension.

11. The molded circuit breaker for an electrical circuit of claim 1, wherein said first cradle extension has a cradle pivot, and wherein said cradle pivot has a substantial circular shape within an opening facing outwardly towards said second cradle extension.

12. The molded circuit breaker for an electrical circuit of claim 1, wherein said second cradle extension has a latch ledge, and wherein said latch ledge protrudes outwardly and away from said operating spring opening.

13. The molded circuit breaker for an electrical circuit of claim 1, wherein average thickness of said second cradle extension is greater than the average thickness of said first cradle extension.

14. A molded circuit breaker for an electrical circuit, comprising:

(a) a first terminal conductor having at least one connector means;

(b) a second terminal conductor having at least one stationary contact;

(c) a magnet, a bimetallic strip, and an armature in electrical contact with at least a portion of said first terminal conductor, said armature having an armature pivot arm, and an armature opening;

(d) a nonconductive nonmagnetic cradle having a first cradle extension and a second cradle extension, said first cradle extension has a first body portion, wherein said first body portion has an operating spring opening at an upper end, a pivot extension at a lower end, and between said upper end and said lower end of said first body portion having a circuit breaker reset arm on a first side and a cradle kick on a second side, said pivot extension has a cradle pivot, said second cradle extension has a second body portion, wherein said second body portion has a latch extension having a latch kick; and (e) a contact arm having a spring hook, and a movable contact, such that a first end of an operating spring is in engageable contact with said operating spring opening and a second end of said operating spring is in engageable contact with said spring hook, and wherein in an ON position said movable contact is in electrical contact with said stationary contact, and in an OFF position said movable contact is disengaged from said stationary contact.

15. The molded circuit breaker for an electrical circuit of claim 14, further comprising a trip unit connected such that said nonconductive nonmagnetic cradle automatically rotates to disengage said movable contact from said stationary contact to actuate said OFF position in response to a predetermined electrical overload and fault current.

16. The molded circuit breaker for an electrical circuit of claim 15, wherein said non-electrically conductive cradle is not excited by an electrical current to establish a magnetic field when said trip unit automatically actuates said OFF position in response to a predetermined electrical overload and fault current.

17. The molded circuit breaker for an electrical circuit of claim 14, wherein said non-electrically conductive cradle prevents a secondary conducting path, while a primary conductive path is created via said second terminal conductor, magnet, bimetallic strip, armature, contact arm, movable contact, stationary contact, and said first terminal conductor in an ON position.

18. The molded circuit breaker for an electrical circuit of claim 14, wherein material for said non-electrically conductive cradle is selected from a group consisting of a plastic material, a polymer material, a polyester material, a non-conductive material, a non-ferrous material, and a composite material.

19. The molded circuit breaker for an electrical circuit of claim 14, wherein a handle moves said non-electrically conductive cradle from an OFF position to an ON position.

20. The molded circuit breaker for an electrical circuit of claim 14, wherein at least a portion of a braid is adjacent said nonconductive, nonmagnetic cradle.

21. The molded circuit breaker for an electrical circuit of claim 14, wherein at least a portion of a braid is adjacent said non-electrically conductive cradle, and wherein there is no arcing and sparking between said braid and said non-electrically conductive cradle when a trip unit automatically actuates said OFF position in response to a predetermined electrical overload and fault current.

22. The molded circuit breaker for an electrical circuit of claim 14, wherein said first cradle extension and said second cradle extension are substantially planar, and wherein said circuit breaker reset arm extends substantially perpendicular to at least a portion of said first cradle extension.

23. The molded circuit breaker for an electrical circuit of claim 14, wherein said cradle kick extends substantially inwardly towards said second cradle extension.

24. The molded circuit breaker for an electrical circuit of claim 14, wherein said cradle pivot has a substantial circular shape within an opening facing outwardly towards said second cradle extension.

25. The molded circuit breaker for an electrical circuit of claim 14, wherein said latch kick protrudes outwardly and away from said operating spring opening.

26. The molded circuit breaker for an electrical circuit of claim 14, wherein average thickness of said second cradle extension is greater than the average thickness of said first cradle extension.

* * * * *